US005663510A

United States Patent [19]

Niemann et al.

[11] Patent Number: 5,663,510

[45] Date of Patent: Sep. 2, 1997

[54] METHOD AND DEVICE FOR COMPENSATING TENSION FORCES ACROSS THE WIDTH OF A MOVING WEB

[75] Inventors: Heinrich Niemann, Enger; Johannes Wulf, Gütersloh, both of Germany

[73] Assignee: Erhardt + Leimer GmbH, Augsburg, Germany

[21] Appl. No.: 585,458

[22] Filed: Jan. 16, 1996

[30] Foreign Application Priority Data

Jan. 20, 1995 [DE] Germany ..... 195 01 644.0

[51] Int. Cl.[6] ..... G01L 5/00

[52] U.S. Cl. ..... 73/862.55; 73/159

[58] Field of Search ..... 73/862.194, 862.195, 73/862.391, 862.42, 862.451, 862.471, 862.472, 862.473, 862.55, 862.622, 159

[56] References Cited

U.S. PATENT DOCUMENTS

| | | | |
|---|---|---|---|
| 2,066,306 | 12/1936 | Horton . | |
| 2,066,307 | 12/1936 | Horton . | |
| 3,260,106 | 7/1966 | Hull et al. | 73/862.474 X |
| 3,763,701 | 10/1973 | Wright et al. | 73/862.474 |
| 4,130,014 | 12/1978 | Eddens | 73/862.622 X |
| 4,326,424 | 4/1982 | Koenig | 73/862.474 |
| 4,629,902 | 12/1986 | Hank et al. | 73/862.473 X |
| 4,691,579 | 9/1987 | Ekola | 73/862.473 |
| 4,735,102 | 4/1988 | Koenig | 73/862.474 |
| 4,899,599 | 2/1990 | Eddens | 73/862.474 X |
| 5,020,381 | 6/1991 | Bartlett | 73/862.474 X |
| 5,257,550 | 11/1993 | Montalvo, III et al. | 73/862.473 X |
| 5,275,062 | 1/1994 | Turley | 73/862.391 X |

FOREIGN PATENT DOCUMENTS 1 057 016 10/1957 Germany .

*Primary Examiner*—Richard Chilcot
*Assistant Examiner*—Elizabeth L. Dougherty
*Attorney, Agent, or Firm*—Collard & Roe, P.C.

[57] ABSTRACT

A method and a device for compensating and equalizing the tension forces across the width of a moving web makes use of a tension compensation roll, which is pivotably supported, and rotatable around a pivotal axis. In the presence of a difference in the tension force across the width of the moving web, the tension compensation roll is pivoted via gears with teeth to an extent such that the tension forces in both halves of the web are equalized.

13 Claims, 4 Drawing Sheets

METHOD AND DEVICE FOR COMPENSATING TENSION FORCES ACROSS THE WIDTH OF A MOVING WEB

BACKGROUND OF THE INVENTION

1. Field of the Invention

The present invention relates to a method and a device for compensating for tension forces across the width of a moving web.

2. The Prior Art

U.S. Pat. No. 2,066,306 discloses a known device which consists of a roll, which is supported freely rotatable on a shaft. At its two ends, the shaft is guided in rocker arms and engaged by a lever system. This prevents the two ends of the shaft from moving in the same direction, so that the shaft, and with it the roll, is supported pivotably only around one axis. However, this known device has the disadvantage that sliding motions occur both in the rocker arms and lever systems when the shaft is pivoting or swiveling. The forces of friction connected therewith limit the accuracy of the compensation of tension achievable with this device. In particular, compensation of tension is not possible if the difference in the tension force between the two sides of the web is lower than the considerable forces of static friction in the rocker arms and lever systems.

SUMMARY OF THE INVENTION

It is an object of the present invention to provide a device or apparatus of the type specified above that assures a precise equalization and compensation for the tension forces across the width of the moving web.

According to the invention, this object is achieved with the method of the invention, as well as with the apparatus or device of the invention.

In connection with this method, a signal proportional to the torque applied by the web to the tension equalization or compensation roll is detected and used as a correction signal for a control unit. In this control unit, the torque exerted by the web is controlled to the desired zero value by rotating or pivoting the tension compensation roll. In this manner, it is possible to achieve the result that the tension forces in both halves of the web are the same when the control unit is in the built-up state. Since rotating or pivoting of the tension compensation roll is actively accomplished by the control unit, influences of friction as well as the mass moment of inertia only play a secondary role in compensating for and in equalizing the tension forces. Such influences only limit the speed at which the difference in the tension force is controlled. The accuracy of the equalization of the tension force is exclusively determined by the precision with which the torque exerted by the web on the tension compensation equalization roll is detected, and by the quality of the controller.

According to another embodiment, it is advantageous to measure the bearing forces on one of the rolls and to calculate the difference in the bearing forces at both ends of the roll. The difference is, when the web runs centered on the roll, proportional to the torque that the web exerts on the roll. The bearing forces on the roll can be determined in a particularly simple and exact way with the help of force-measuring devices, for which provision is made in the bearings. Preferably, the bearing forces are determined on the tension compensation equalization roll. This assures that the tension force in the web is correctly detected without being influenced by influences of friction on other rolls.

Furthermore, in this way, time delays between the pivoting of the tension compensation and equalization roll and the effect on the tension force in the web are kept to a minimum. Therefore, the control unit is capable of compensating more rapidly for any difference occurring in the tension force.

According to a further embodiment, it is desirable to additionally detect the position of the center of gravity of the web and to correct the difference in the bearing force. Based on the difference in the bearing forces on the roll it is possible also to determine a torque based on the center of gravity of the web. However, if the web is moving off center, it is necessary to compensate for the torque that is based on the center of gravity of the web. This is quickly accomplished by computing the deviation in the difference of the bearing forces, such deviation being conditioned by the movement of the web, and by then correcting the determined difference in bearing force by this value.

According to another embodiment, it is advantageous to compare the torque exerted by the web on the tension equalization or compensation roll with a desired torque value range. Depending on the result of such comparison, the position of the tension compensation roll is either controlled and thus actively adjusted, or is maintained freely rotatable or pivotable. Keeping it freely pivotable has the special advantage that the tension force is exactly and particularly compensated for between the two halves of the web, and is compensated for irrespective of the accuracy with which the tension force is measured. The position of the tension compensation roll is controlled only in the presence of large deviations between the desired value and the actual value, and thus is actively adjusted. This assures that any large difference in the tension force between the two halves of the web is corrected very rapidly, because the servo-actuators for pivoting or rotating the tension compensation equalization roll are capable of producing substantially more force than the web itself. This is important especially in connection with large rolls, which have a moment of inertia that is corresponding high. In order to assure an effective transmission of force to the tension equalization compensation roll through the control unit, the pivoting or rotating support of the tension compensation roll is blocked in this embodiment.

The device according to a further embodiment, has a swivel-mounted pivotable tension compensation equalization roll. This roll is supported so as to be freely rotating around a shaft; and the ends of the shaft are supported in a pivotable or swiveling bearing. This assures that the space around the tension compensation roll is unobstructed, so that the movement of the web is not interfered with in any way. The swivel bearing of the shaft is achieved with the use of gears with teeth, which are provided at both ends of the tension compensation roll. When the web exerts a torque on the tension equalization compensation roll, this torque tries to move the tension compensation roll in the direction of the force on the side of the higher tension force. The gears with teeth translates this motion of the tension compensation roll into a rotational motion of the shaft. This rotational motion is translated in turn by the opposite end of the shaft into rotation in the opposite direction. The mechanism assures that the tension compensation equalization roll is supported pivotably or rotatably only around one axis and that it cannot be displayed as a whole. This, in turn, causes the result that in the presence of varying overall tension force in the web, that the tension compensation or equalization roll will not reach any of its end stops. Therefore, equalization of the tension force across the width of the web is assured under any operating conditions. The use of gears with teeth for swivel-mounting the shaft results in particularly low frictional forces because the teeth of the gears engage each other in a rolling manner without sliding over one another.

Support of the ends of the shaft by means of rocker arms is accomplished using antifriction bearings rolling on the rocker arms. In this way, friction forces originating from the rocker arms are mostly eliminated. Therefore, the force required for pivoting or rotating of the tension compensation or equalization roll is very low, so that the tension in the web can be compensated for solely by the torque transmitted by the web even without actively adjusting the tension compensation roll. The desired equalization of tension is thus accomplished with the simplest of means at particularly low cost. Furthermore, the device can be structured in a very compact way, so that even existing equipment can be retrofitted without problems by simply replacing a roll.

According to another embodiment, ball bearings or roller bearings have been successfully used as antifriction bearings. These bearings have very favorable rolling properties, whereby the frictional force in particular is negligibly low. Ordinarily, this frictional force is damaging to exact tension compensation or equalization. The ball bearing or roller bearing rests against a rail or column only on one side, such rail or column serving as the abutment or raceway, on which the bearing is rolling. This abutment limits the freedom or movement of the tension compensation roll to one plane. This prevents the tension compensation or equalization roll from rotating around an axis vertical to the desired pivotal axis, which would cause the web to move with lateral displacement. Furthermore, the abutment assures a correct position of the parts of the gears with teeth, so that the teeth always mate correctly.

According to a further embodiment, it is advantageous to form toothed gearing from a bar having teeth and a gear having teeth. Preferably, the gear with teeth mates directly with the bar having teeth, which minimizes the friction losses of the pivoting or rotating bearing. Since the bar having teeth is stationary, the gear with teeth has to roll along on this bar when the tension compensation or equalization roll is adjusted whereby gear with teeth is rotated together with the shaft. Preferably, the bars having teeth are fitted on both ends of the shaft on diagonally opposed ends of the axis of the shaft. The effect of this is that the adjustment of the ends of the shaft relative to each other is synchronized in opposite directions. Therefore, the tension compensation or equalization roll can be pivoted only around a fixed, predetermined axis of rotation which, with the gear with teeth mating with the bar with teeth, extends through the center of gravity of the tension compensation or equalization roll. Alternatively, the bar with teeth could be mounted also on the same side of the axis of the shaft. In this case, one of the gears with teeth would have to have an intermediate gear with teeth for reversing the rotary motion on that side. For minimizing the frictional forces between the gear with teeth and the bar with teeth, it is desirable to equip these elements with an envelope of meshing teeth.

According to another embodiment, it is desirable to provided for an intermediate gear with teeth between the bar with teeth and the shaft. In this way, the pivotal axis of the tension compensation or equalization roll can be displaced in any desired way in a simple manner. The height of this pivotal axis with respect to the tension compensation or equalization roll is fixed by the axis of the intermediate gears mating with the bar having teeth.

In particular in connection with printing machines, it is desirable that the center line of the web is not longitudinal shifted in any way by the tension compensation or equalization roll. According to another embodiment, this is accomplished by having the pivotal axis of the tension compensation roll shifted to its jacket. The pivotal axis is tangent to the tension compensation roll in the zone where the roll is looped by the web; therefore, the lateral and longitudinal sensors remain uninfluenced.

If the bar having teeth is constructed in the form of a threaded spindle or worm gear, the vertical position of the tension compensation equalization roll can be adjusted in a very simple way by turning the threaded spindle or worm gear.

If, according to another embodiment, the threaded spindles or worms are connected with servo-actuators, pivoting or rotation of the tension compensation or equalization roll can be actively effected by the servo-actuators. In order to prevent the tension compensation roll from freely rotating due to the pressure of the web, the shaft is locked against rotation around its longitudinal axis. Pivoting or rotating of the tension compensation roll by means of servo-actuators offers the advantage that its mass inertia can be overcome more easily than if the web itself were required to produce the adjusting force.

According to a further embodiment, it is desirable to connect the servo-actuators with a control unit device. The control unit receives an actual value from force-measuring devices, for which provision is made in the bearings of a roll. The measured values of force are deducted from each other via a subtractor, whose initial value is proportional to the torque exerted by the web on the tension compensation equalization roll. This value is adjusted to the desired value of zero by the control unit, so that in the activated state of the control unit, the tension forces in of the web are equal to each other in both halves of the web.

Finally, according to another embodiment, it is advantageous to detect the position of both edges of the web by means of an edge sensor when the web is moving off center, and to link this value to the measured bearing forces. In this way, it is possible to calculate the difference in bearing forces created by the movement of the web, and to correct this difference in such a way that the controller is supplied with a signal that is proportional to the torque of the web based on the center of the web.

BRIEF DESCRIPTION OF THE DRAWINGS

Other objects and features of the present invention will become apparent from the following detailed description considered in connection with the accompanying drawing which discloses several embodiments of the present invention. It should be understood, however, that the drawing is designed for the purpose of illustration only and not as a definition of the limits of the invention.

In the drawing, wherein similar reference characters denote similar elements throughout the several views.

DETAILED DESCRIPTION OF PREFERRED EMBODIMENTS

Figure 1:
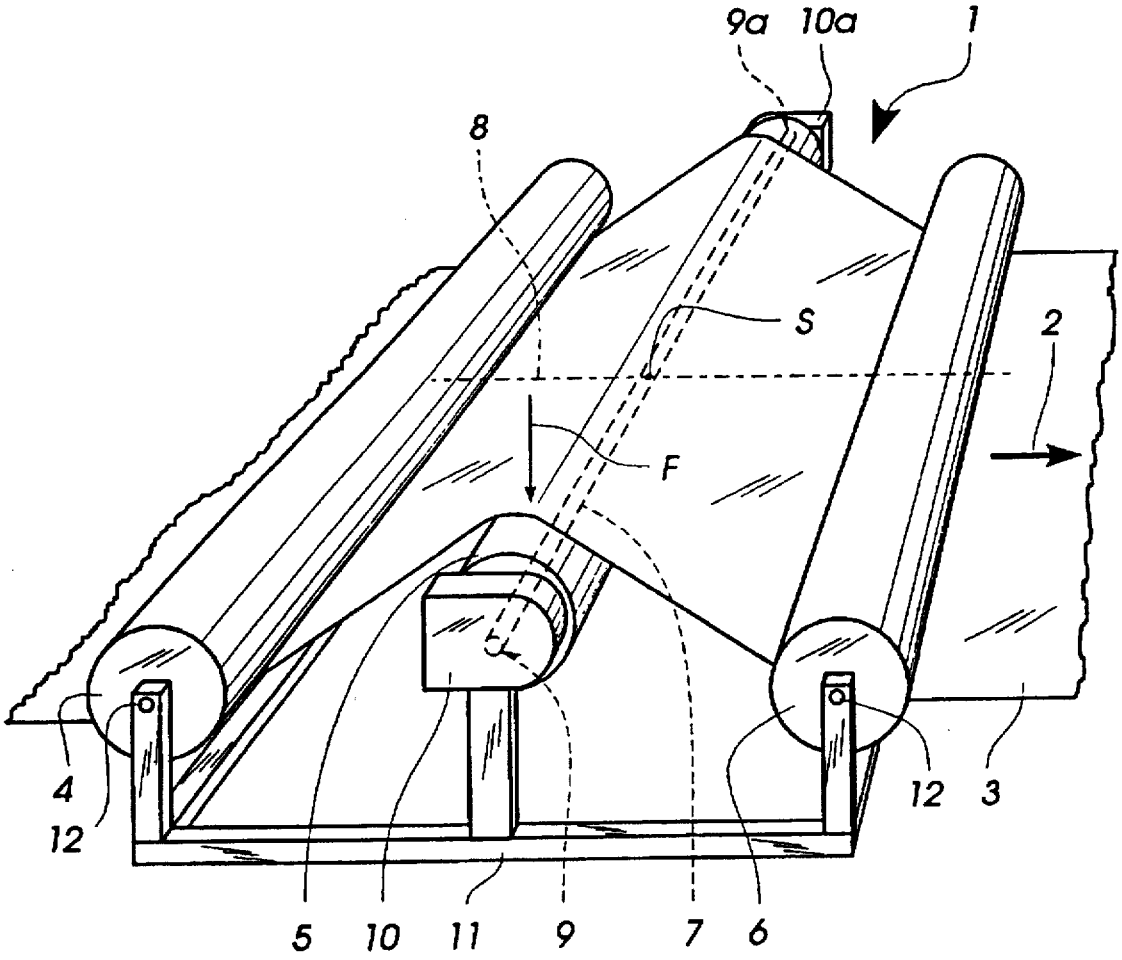
FIG. 1 shows a perspective view of a device for equalizing the tension forces in a web.

Turning now in detail to the drawings, FIG. 1 shows a device for compensation or equalizing the tension forces across the width of a web 3 moving in the direction of arrow 2. Web 3 is contacted by the rolls 4, 5, 6 supported in the bearings 12, whereby the center roll 5 is designed as a tension equalization or compensation roll. Rolls 4 and 6 denote the guide-pulleys which exert a downward pressure on the web. The tension compensation or equalization roll 5 is supported for freely rotating on a shaft 7; and shaft 7 is swivel-mounted for pivoting or rotating around a pivotal axis 8 extending through its center of gravity S. Roll 5 is between rolls 4 and 6 and reverses the moving web to the upwardly direction. The two ends 9 and 9*a* of the shaft 7 are supported in the bearings 10 and 10*a*, respectively, which are mounted on a frame 11 and jointly forming a swivel bearing for the shaft 7.

Figure 2:
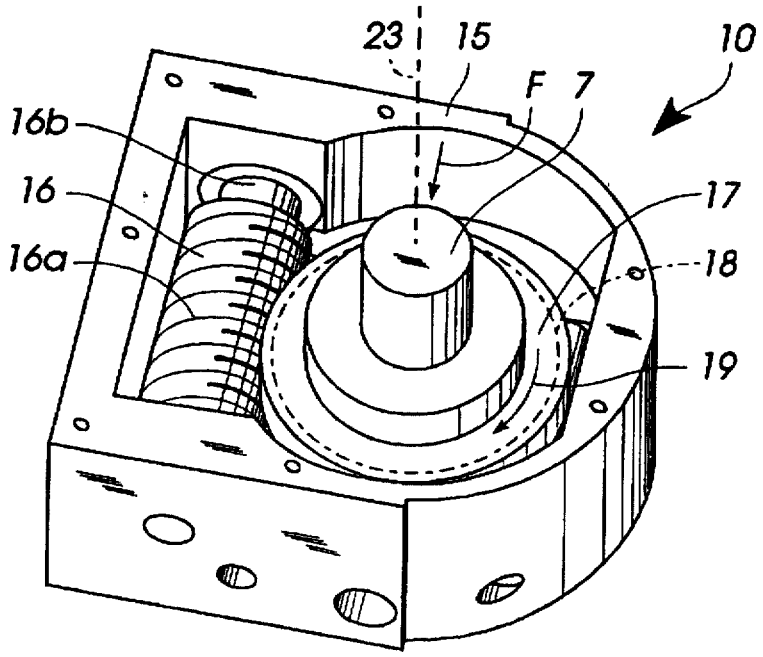
FIG. 2 shows a perspective view of one side of a swivel bearing.

The structure and function of the bearings 10 and 10*a* are explained in greater detail by reference to FIGS. 2 and 3. FIG. 2 shows the bearing 10, which includes a housing block 15, which has its cover removed. A stationarily mounted rack with teeth is a threaded spindle 16 and is accommodated in the housing block 15. The threaded spindle mates with a gear 17 having the teeth 18. The gear 17 is torsionally rigidly joined with the shaft 7.

In practical application, the web 3 applies pressure to the shaft 7 with a force F of FIG. 1 and attempts to displace the shaft in the direction of arrow F. Since the gear 17 mates with the threaded spindle 16, gear 17 rolls around on the threaded spindle 16 during such displacement, so that it is simultaneously caused to rotate in the direction 19. In the bearing 10, for which provision is made at the opposite end 9*a*, the shaft 7 is supported analogously but diagonally opposed to the illustration shown in FIG. 2, with the result that the described rotation 19 of the gear 17 having teeth 18 and thus of the shaft 7 effects at its opposite end 9*a* displacement directed against the force F. The motions of the ends 9 and 9*a* of the shaft 7 are therefore synchronized in opposite directions relative to one another, so that the shaft 7 and thus the tension compensation equalization roll 5 is pivotable only around the pivotal axis 8 indicated in FIG. 1.

Figure 3:
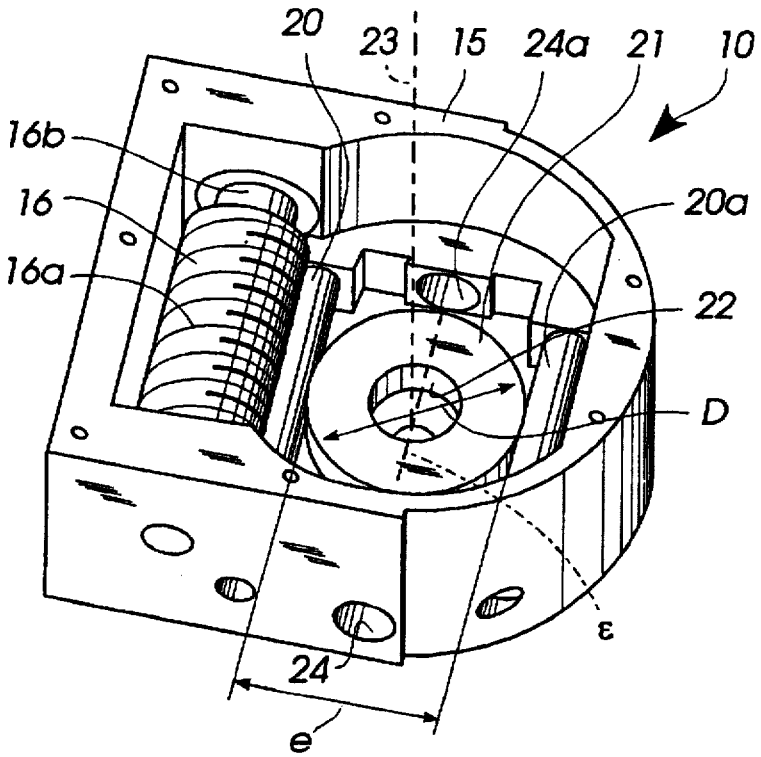
FIG. 3 shows the swivel bearing according to FIG. 2 without toothed gear.

FIG. 3 shows the bearing 10 according to FIG. 2, whereby the gear 17 having teeth 18 with the shaft 7 is removed in order to be able to view the parts disposed underneath. In the housing block 15, the two columns 20 and 20*a* are fixed into position a spaced apart distance e; and these columns form a rocker-arm guide for the shaft 7. For this purpose, the shaft 7 supports an antifriction bearing 21, which is shown alone and only with its receiving opening 22. The antifriction bearing 21 is positioned between the columns or rocker arms 20 and 20*a*; and the spacing e from one columns to another is slightly greater than the outside diameter D of the antifriction bearing. In this way, the antifriction bearing 21 only rests against one of the two columns 20 or 20*a*, rolling off on the latter without sliding. The rocker-arm guidance has the effect that the shaft 7 is capable of moving only within one plane $\epsilon$. This assures that the axis 23 of the shaft 7 is always spaced the same distance from the threaded spindle 16 so that the teeth 16*a* of the threaded spindle 16 and the toothed gear 17 correctly mate with each other. This is important, so that the teeth 18 of the gear 17 roll along the teeth 16*a* of the threaded spindle 16 without sliding.

In the housing block 15, provision is made for the through-extending bores 24 and 24*a* in the plane of movement of the antifriction bearing 21. In these bores, provision is made for stops (not shown) for limiting the path of adjustment of the shaft 7 on both sides. In addition, provision could be made for a shock absorber in one of the through-extending bores 24 and 24*a*, and this shock absorber is for damping the vibratory motions of the shaft 7.

Figure 4:
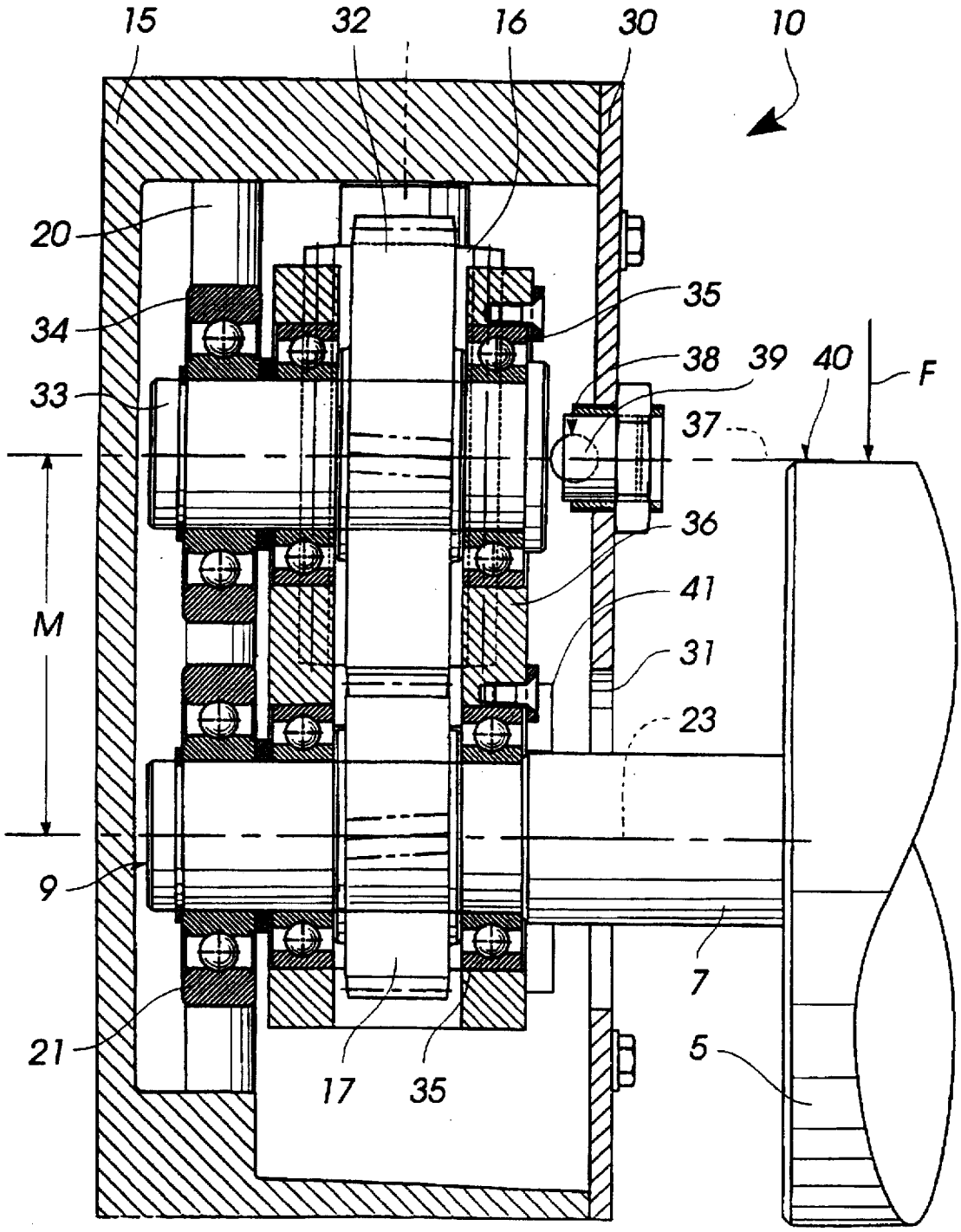
FIG. 4 shows a sectional view of another embodiment of one side of a swivel bearing with displaced pivotal axis.

FIG. 4 shows another embodiment of the bearing 10. This bearing includes a housing block 15, on which a cover 30 is secured. The cover 30 has an opening 31 penetrated by the shaft 7. The shaft 7 is supported on the columns 20 by means of the antifriction bearing 21 and torsionally rigidly joined with the toothed gear 17. The toothed gear 17 mates with an intermediate toothed gear 32, the shaft 33 of which is supported on the columns 20 as well by means of another antifriction bearing 34. The shafts 7, 33 are supported on a cage or frame 36 by means of the antifriction bearings 35, and this cage keeps the mutual spacing M constant between the shaft axis 23 and the shaft axis 37. The two antifriction bearings 21 and 34 permit an up-and-down movement of the cage 36 in the direction of force F. However, they prevent the cage or frame 36 from moving sideways, as well as from pivoting or rotating. In order to keep the shaft 33 in position in the longitudinal direction, provision is made in the cover 30 for a stop 38, which presses against the shaft 33. Preferably, stop 38 is a ball 39 which is elastically supported. The stop 38 limits the movement of the cage 36 only in one direction; however, provision is made at the opposite end 9*a* (shown in FIG. 1) of the shaft 7 for a similarly structured bearing 10*a*, which limits the movement of the cage 36 there in the opposite direction. Since the two cages 36 are connected with the shaft 7, any movement of the shaft 7 in the direction of its longitudinal axis 23 is prevented.

So as to place the pivotal axis 8 tangentially to the jacket 40 of the tension compensation roll 5, where the web 3, too, comes into contact with the tension compensation roll 5, provision is made for an intermediate gear 32 with teeth mating with the threaded spindle 16 and the gear 17 with teeth, with the axis 37 of said intermediate gear being aligned with the jacket 40. The diameters of the gears 17, 32 are dimensioned correspondingly.

So that the tension compensation roll 5 can be pivoted also by an active control unit by means of servo-actuators, the threaded spindle 16 penetrates the housing block 15 with its lower end 16*b*. In this way, the threaded spindle 16 can be connected with a servo-actuator, for example an electric motor or a hydraulic motor, the latter enabling the spindle to rotation. Such rotation of the threaded spindle 16 is transmitted to the shaft 7 via the gears 32 and 17 with teeth. In this case, the bearing 10*a* disposed at the opposite end 9*a* of the shaft 7 has a servo-actuator as well. Both servo-actuators are coupled in the opposite direction, so that one bearing 10 causes an upward movement of the shaft end 9, and the opposite bearing 10*a* effects a downward movement of the shaft end 9*a*. So that the rotation of the threaded spindle 16 is translated into an adjustment of the cage 36, and not only causes a turning of the shaft 7, provision is made for a braking device 41 on the cage 36. This braking device acts against the shaft 7 and, in its applied position, prevents the shaft from rotating relative to the cage 36. In the released position, the braking device 41 is spaced from the shaft 7, so that the tension compensation and equalization roll 5 can rotate freely.

Figure 5:
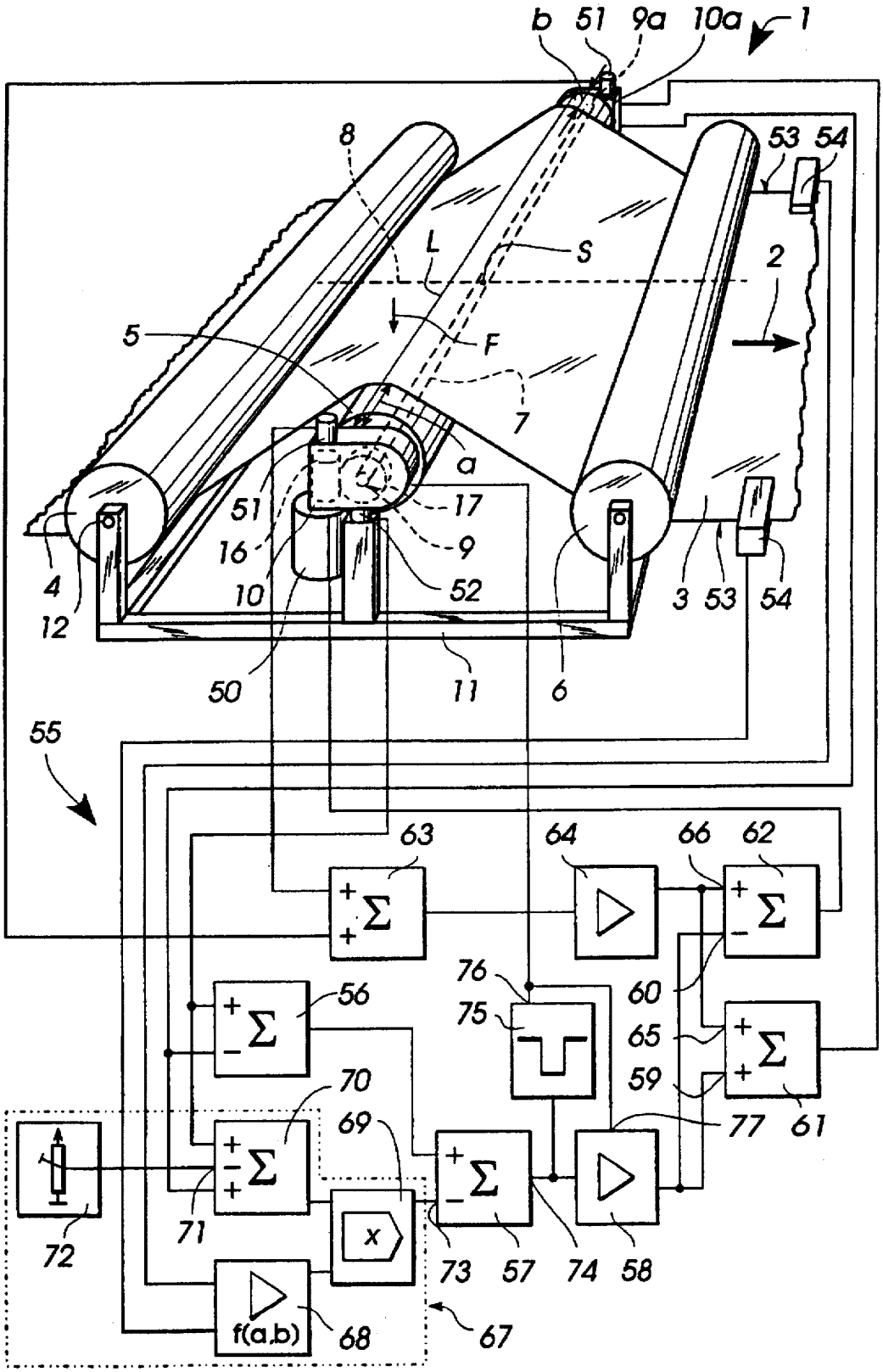
FIG. 5 shows an active control unit device for equalizing the tension forces in a web.

FIG. 5 shows a further embodiment of the device 1 with active adjustment of the tension compensation and equalization roll 5. The basic structure is analogous to that of the device 1 according to FIG. 1, whereby the shaft 7 is locked against rotation around its longitudinal axis 23. The threaded spindles 16 of the bearings 10 and 10*a* are connected with the servo-actuators 50. Such actuators may be electric motors with flanged-on transmissions, or hydraulic drives. The servo-actuators 50 enable the threaded spindles 16 to rotate and in this way cause a vertical adjustment of the ends 9 and 9*a* of the shaft 7. The servo-actuators 50 are actively connected with the path-sensing devices 51, which detect the path of adjustment of the threaded spindle 16. Since the rotational motion of the threaded spindle 16 is coupled with the shaft 7 via the gear 17 with teeth, the signal obtained from the path-sensing device 51 is proportional also to the path of adjustment of the ends 9 and 9a of the shaft 7. Between the bearings 10 and 10a and the frame 11, provision is made for the force-measuring devices 52, which detect the bearing forces F exerted by the tension compensation equalization roll 5 and the web 3. On the two web edges 53, provision is made for the edge sensors 54 for continuously detecting the position of the web.

The servo-actuators 50, the path-sensing devices 51, the edge-measuring devices 52 and the edge sensors 54 are actively connected to a control unit device 55. This control unit device 55 has the function of compensation for the differences in the tension force in both halves of the web by adjusting the tension compensation equalization roll 5. An adder 56 is actively connected to the force-measuring devices 52 on the input side, and computes the difference between the bearing forces measured, with this difference being proportional to the torque exerted by the web 3 on the tension compensation roll 5. The output signal of the adder 56 is supplied to a controller 58 via another adder 56, with this controller 58 preferably having a P-, PI- or PID-capability. The correction signal obtained from the controller 58 is supplied to a non-inverting input 59 as well as to an inverting input 60 of the adders 61, 62, which are actively connected to the servo-actuators 50 via power amplifiers (not shown). When a difference in bearing force occurs between the ends 9 and 9a of the shaft 7, the control loop effects a vertical adjustment of the shaft 9 in opposite senses, i.e., it pivots the shaft. In order to keep the position of the pivotal axis 8 of the shaft 7 constant, the mean value of the paths of adjustment of the ends 9 and 9a of the tension compensation of equalization roll 5 is controlled as well. For this purpose, the path-sensing devices 51 are connected to another added 63, and the output signal of the adder 63 is proportional to the mean value of the paths of adjustment of both ends 9 and 9a of the shaft 7. The signal is controlled to a constant desired value by another controller 64. The controller 64, too, preferably has a P-, PI- or PID-capability. The correction signal obtained from the controller 64 is received by the non-inverting inputs 65, 66 of the adders 61, 62, respectively, and thus causes an adjustment of the two ends 9 and 9a of the shaft 7 in the same direction. The mean position of the tension compensation or equalization roll 5 and thus the position of its pivotal axis 8 is fixed via this control loop.

The afore-described control circuits require that the web 3 runs centered across the tension compensation or equalization roll 5, so that in the presence of equal tension forces in both halves of the web, the two bearing forces F are equal as well, and their difference is equal to zero. Should the web, in an exceptional case, move across the tension compensation or equalization roll 5 off center, such off center movement causes a torque even with compensated tension forces in both halves of the web, and thus different bearing forces F act on both ends 9 and 9a.

In order to achieve proper control of the tension force, it is also possible to provide in a further embodiment a correction device 67. This device 67 has a circuit block 68 which, on the input side, is actively connected to the edge sensors 54. Based on the signals received from the edge sensors 54, the circuit block 68 computes the following expression:

$$f = 2 \cdot \frac{L(a-b) + b^2 - a^2}{L(L-a-b)} \quad (1)$$

whereby, a, b corresponds to the horizontal spacings of the web edges 53 from the edge-measuring sensors 54, and L corresponds to the spacing of the two force-measuring devices 52.

The signal f computed by the circuit block 68 is multiplied in a multiplier 69 with a signal corresponding to the total force exerted on the tension compensation equalization roll 5 by the web 3. This signal is obtained from an adder 70 which, on the input side, is actively connected to the force measuring devices 52. Via an inverting input 71, the adder 70 is connected to a coefficient member 72, with the help of which the force of weight of the tension compensation equalization roll 5 is subtracted form the values measured by the force-measuring devices 52. The multiplier 69 computes the difference in force between the two ends of the shaft 7 that is caused by the off center movement of the web. This value is supplied to an inverting input 73 of the adder 57, so that a signal proportional to the difference in tension force between the two halves of the web is available at the output 74.

A window comparator 75 is connected to the output 74 of the adder 57 and compares the control deviation with two fixed limit values. A zero level is available on a digital output 76 of the window comparator 75 if the control deviation is within the range between the limit values. The digital output 76 is actively connected to a holding input 77 of the controller 58, which becomes inactive if the level is zero. This is desirable, so that integrators in the controller 58 will not assume any undefined starting values. In addition, the output 76 is actively connected with a braking device of the bearing 10; and this braking device locks the shaft 7 against rotation around its longitudinal axis if the level is one, so that the servo-actuators 50 are capable of adjusting the tension compensation roll 5. What is accomplished through this special arrangement is that in the event of a significant control deviation, the shaft 7 is blocked, and the servo-actuators 50 actively adjust the tension compensation roll 5 via the threaded spindles 16. Such adjustment takes place very rapidly, because the servo-actuators 50 are capable of exerting relatively high forces on the tension compensation roll 5. When the tension forces in both halves of the web are almost equalized, i.e., once the control deviation on the output 74 is within the range fixed by the window comparator 75, the controller 58 is switched off via the holding input 77 and blocking of the shaft 7 is released. This means that the tension compensation roll 5 is again freely pivotable and automatically adjusts itself to the web under the effect of the tension force.

The control device 55 can be created by utilizing either analog or digital computing circuits. In particular, realization by means of a microcomputer is advantageous because it is possible in this case to take into accout additional functions such as changes in the control algorithm, which can be easily done by adapting the program accordingly.

While several embodiments of the present invention have been shown and described, it is to be understood that many changes and modifications may be made thereunto without departing from the spirit and scope of the invention as defined in the appended claims.

What is claimed is:

1. Method for compensating and equalizing the tension forces across the width of a pulled moving web comprising:

providing a tension compensation roll for reversing the web;

pivoting said tension compensation roll around a pivotal axis disposed approximately perpendicular to said tension compensation roll;

said pivoting of the tension compensation roll taking place by detecting and controlling a torque exerted on the tension compensation roll by the web;

wherein said detecting of the torque of the web exerted on the tension compensation roll comprises measuring the bearing forces at both sides of the tension compensation roll; and computing the difference between these bearing forces.

2. Method according to claim 1, wherein the web is selected from the group consisting of paper or foil.

3. Method according to claim 2, comprising detecting the position of the web which has marginal edges by sensing said marginal edges; and correcting the determined difference of the bearing forces by the deviation due to the moving of the web.

4. Method according to claim 1, comprising comparing the torque exerted on the tension compensation roll by the web with a range of torques between two limit values, whereby in the presence of torques within said range, the tension compensation roll is maintained freely pivotable, or is otherwise controlled with respect to its position.

5. Device for compensation and equalizing tension forces across the width of a pulled moving web comprising a tension compensation roll for reversing the moving web and being freely rotatable;

a shaft supporting said tension compensation roll and rotatable around a longitudinal axis;

a swivel bearing supporting the shaft and the swivel bearing supported in a frame;

said shaft supported and guided in column rocker arms on both sides of the tension compensation roll;

means for coupling the movement of two ends of the shaft in opposite directions;

said shaft movably supported on both ends of the tension compensation roll by gears with teeth and supported in the column rocker arms by antifriction bearings.

6. Device according to claim 5, wherein the antifriction bearing is a ball bearing or roller bearing fixed on the shaft, and said bearing being supported on a rail as an abutment.

7. Device according to claim 5, wherein the gears with teeth are formed by a rack with teeth, which is actively connected with a gear having teeth torsionally rigidly joined with the shaft.

8. Device according to claim 7, wherein an intermediate gear with teeth serving as an active connection between the rack with teeth and the gear with teeth joined to the shaft.

9. Device according to claim 8, wherein the axis of the intermediate gear with teeth is aligned with a jacket surface of the tension compensation roll.

10. Device according to claim 7, wherein the rack with teeth comprises a threaded spindle or worm.

11. Device according to claim 10, wherein two threaded spindles or worms are engaged by servo-actuators, said actuators being coupled with each other in opposite directions, and that the shaft is locked against rotation around its longitudinal axis.

12. Device according to claim 10, wherein the servo-actuators are actively connected with a controlling device, said device being influenced at least by force-measuring devices, with said force-measuring devices being provided on the tension compensation roll.

13. Device according to claim 10, wherein the controlled device is influenced by at least one edge sensor detecting the position of the edge of the web.

* * * * *